United States Patent [19]

Jones

[11] 4,335,482

[45] Jun. 22, 1982

[54] ROTARY BRUSH MOUNTING

[75] Inventor: Peter A. Jones, March, England

[73] Assignee: Melford Engineering Limited, Cambridgeshire, England

[21] Appl. No.: 160,928

[22] Filed: Jun. 19, 1980

[30] Foreign Application Priority Data

Jun. 19, 1979 [GB] United Kingdom ..... 7921386

[51] Int. Cl.[3] ..... E01H 1/04

[52] U.S. Cl. ..... 15/87

[58] Field of Search ..... 15/87, 385, 340

[56] References Cited

U.S. PATENT DOCUMENTS

| | | | |
|---|---|---|---|
| 1,750,829 | 3/1930 | Wilson | 15/87 |
| 2,655,678 | 10/1953 | Keogh | 15/87 |
| 3,292,195 | 12/1966 | Schmidt et al. | 15/87 |
| 3,790,981 | 2/1974 | Young | 15/87 |

FOREIGN PATENT DOCUMENTS

| | | | |
|---|---|---|---|
| 2153518 | 5/1973 | Fed. Rep. of Germany | 15/87 |
| 589948 | 7/1947 | United Kingdom | 15/87 |

*Primary Examiner*—Edward L. Roberts

*Attorney, Agent, or Firm*—Watson, Cole, Grindle & Watson

[57] ABSTRACT

A rotary brush mounting comprises support structure mountable from a sweeping machine and carrying support means for angular movement about pivotal axes at right angles to one another in a universal manner and a driven rotary brush depending from the support means and normally rotatable about a substantially vertical axis but capable of sideways and back and forth inclining movement with the support means so as to follow varying formation or irregularities of a road or similar surface in order to maintain effective sweeping contact therewith. The support structure may consist of a bracket having a pivoted arm extending for swinging movement and carrying the support means which latter may consist of a forked member longitudinally pivoted on the arm and carrying between its limbs for transverse pivotal movement a support member for the brush together with a direct motor drive to the latter. Universal pivotal movement of the support means may be damped and also spring urged to the normally upright position of the brush. Swinging movement of the pivoted arm of the support structure may be also damped.

10 Claims, 3 Drawing Figures

ROTARY BRUSH MOUNTING

BACKGROUND OF THE INVENTION

Field of the Invention

This invention relates to the mounting of a rotary brush or brushes of a machine for sweeping roads, pavements or similar surfaces in which the or each such brush is rotatable about a substantially vertical axis in position of use.

SUMMARY OF THE INVENTION

The object of the invention is to provide an improved mounting of such a brush in a sweeping machine or vehicle whereby the brush is able to more closely follow road or like surface formations or irregularities in obtaining a more thorough sweeping action. Practical advantages in this and other respects will be apparent from the following disclosure.

According to this invention rotary brush mounting of the kind above referred to is characterised by a support member for the rotary brush being mounted or mountable from the sweeping machine for angular movement at least about pivotal axes at right angles to one aother in a universal manner whereby the brush is able to effect sideways and/or back and forth inclining movement in following road or like surface formations or irregularities.

BRIEF DESCRIPTION OF THE DRAWINGS

In the accompanying drawings there is shown a practical arrangement of the rotary brush mounting in which.

Figure 1:
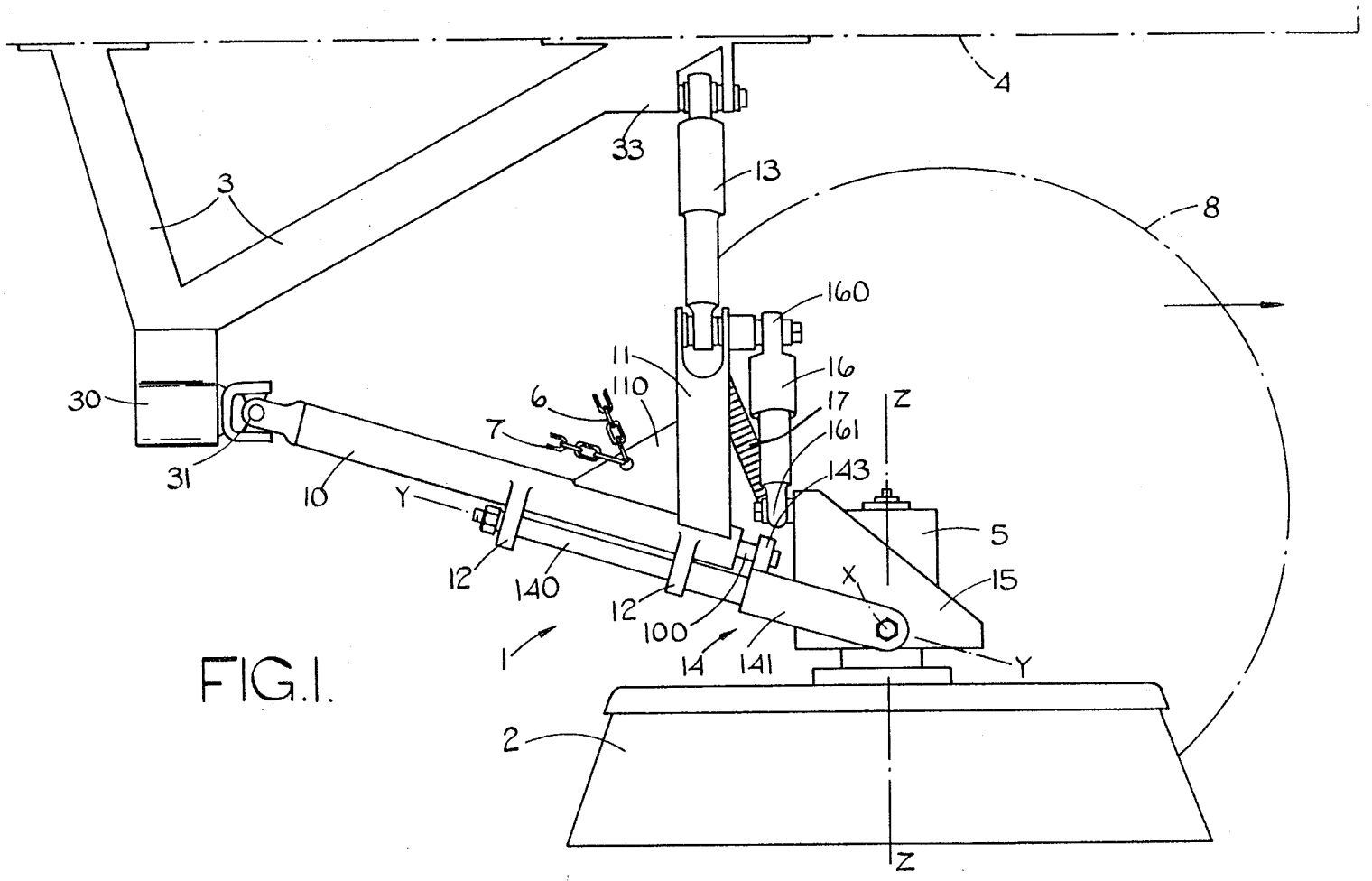
FIG. 1 is a side elevation.
Figure 2:
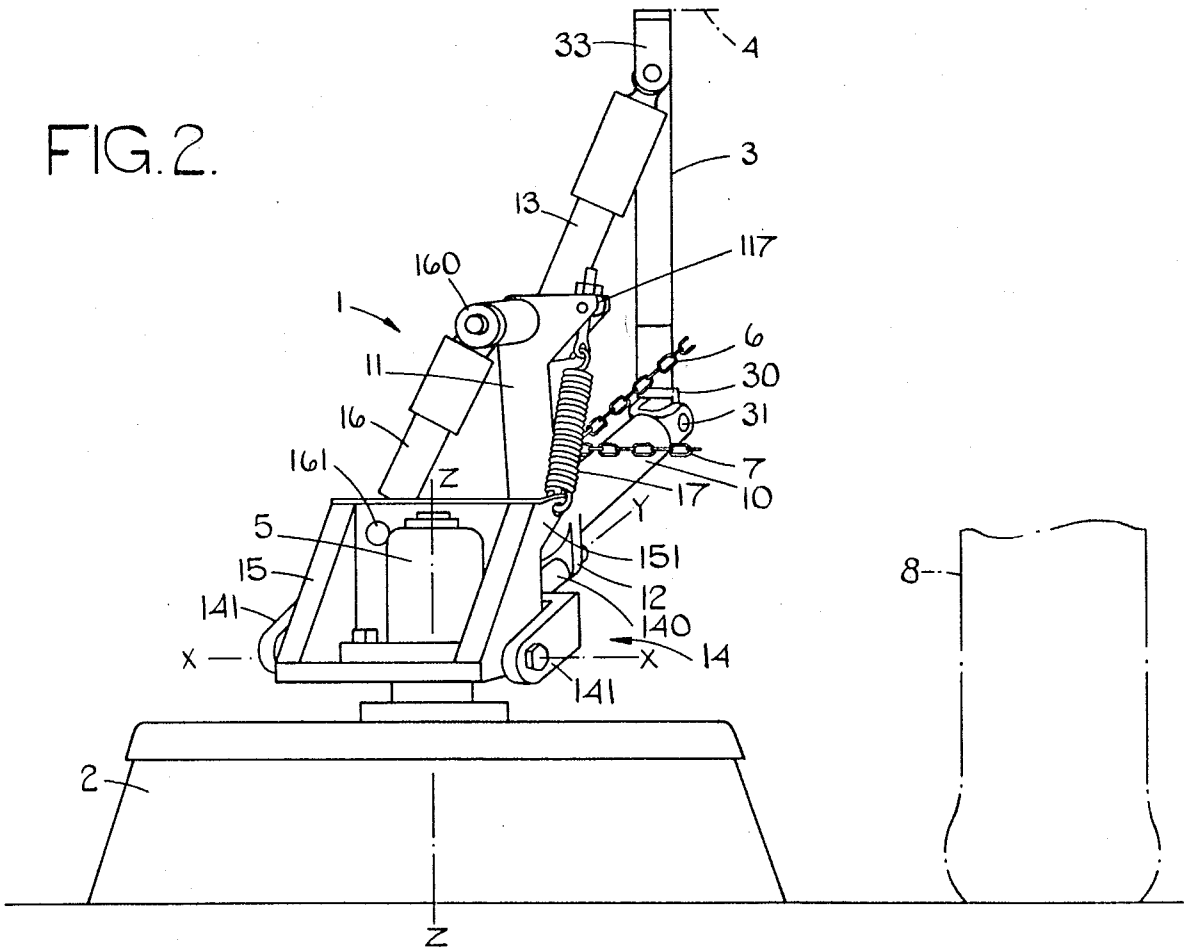
FIG. 2 is a front view.
Figure 3:
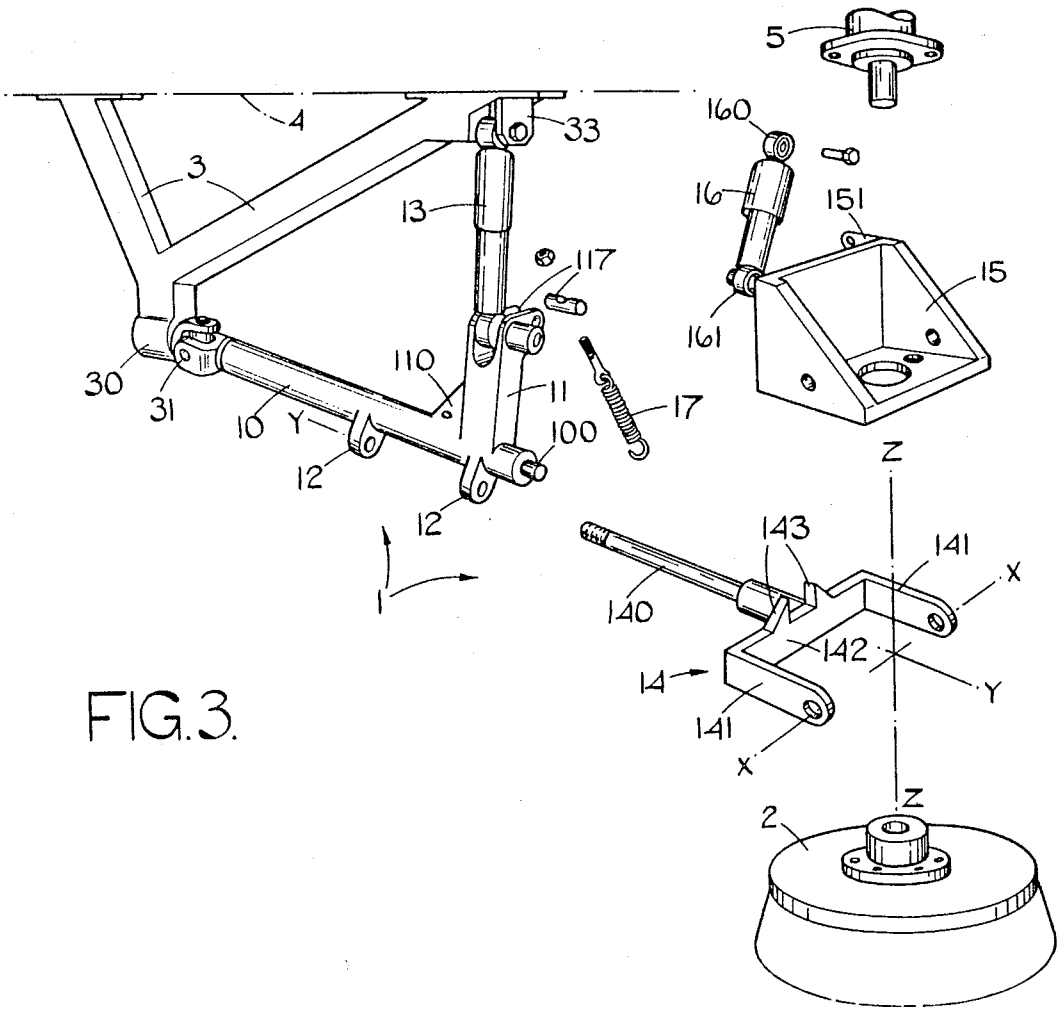
FIG. 3 is an exploded perspective view illustrating components of the mounting.

The mounting 1 of the rotary brush 2 is carried by bracket structure 3 from a forward underpart 4 of the sweeping machine or vehicle whereby the brush 2 is outwardly directed or splayed for sweeping road, pavement or similar surfaces, e.g. up to and against kerbs or the like. Thus the machine may forwardly carry a pair of such brushes 2 one at each side and alongside a front road wheel 8 or wheels of the machine. However the mounting is also applicable to a third or further similar brush or brushes, e.g. carried by an arm or like structure for forward and/or lateral extension from the machine.

Carried from a rear lower part 30 of the bracket structure 3 by a universal joint 31 is a forwardly extending swing arm 10 normally having a downward inclination and supported at its forward end part by a hydraulic damper 13 pivotally connected between a forward upper part 33 of the bracket structure 3 and the upper end of an upright 11 extending from the arm 10 and fast therewith. The underside of the arm 10 carries a pair of lugs 12 providing bearings in which is journalled the shaft 140 of a fork member 14, the limbs 141 of which carry at their forward ends about a transverse axis X a support member 15 for the rotary brush 2, which support member 15 is also shown carrying a hydraulic motor 5 for directly driving the brush 2.

The pivotal axis Y of the fork shaft 140 and the transverse pivotal axis X of the support member 15 in the fork limbs 141 intersect at right angles to one another and provide, in effect, universal mounting of the brush 2 so that it is able to have inclining movement sideways and/or in a back and forth direction. Preferably, and as shown, the intersection of the axes X and Y lies on the normally vertical axis Z of rotation of the brush 2.

Sideways inclination of the brush 2 about the axis Y and also back and forth inclination about the axis X enables the brush 2 to closely follow variations in the surface being swept in a self-accommodating manner, e.g. in following recesses such as gutters or gulleys as well as raised or inclined portions such as road camber. As a result a thorough cleaning action is obtained and the tendency for recesses or crevices to be left uncleaned is avoided or greatly minimised. In particular and on the brush 2 encountering a recess lying forwardly in its path, the brush is able to forwardly incline to enter the recess and then rearwardly incline to move out of it with forward movement of the machine.

In order that such inclining movements may take place in a controlled manner, i.e. without undue freedom, the movements are damped by a hydraulic damper 16 shown connected between a rear part of the support member 15 and the upper end of the upright 11. To permit the inclining movements, the damper 16 is connected by a ball joint 160 to the upright 11 and in order to damp sideways inclining movement is connected in an offset manner at 161 to the support member 15, i.e. at or adjacent the outer upper corner of the rear of the support member 15.

In order to urge the support member 15 such that the brush 2 tends to assume a position in which its axis Z of rotation is substantially vertical (i.e. when the brush 2 is not influenced by surface conditions), spring loading is provided in the form of a tension spring 17 which is connected between a lug 151 at the other upper rear corner of the support member 15 and a pivotal anchorage 117 at the upper end of the upright 11. Thus the spring 17 operates in conjunction with the damper 16 for obtaining the desired action of the brush 2 under operating conditions.

The action of the damper 16 about the universal or ball joint mounting 160 restrains the extent of forward or rearward inclining movement of the brush 2 and in order to limit sideways inclination, stop means is provided and is shown consisting of a pair of projections 143 on the cross member 142 of the fork which co-operate with a forward reduced extremity 100 of the arm 10.

When the brush is not required for use, i.e. during travelling movement of the machine from one location of use to another, the complete mounting 1 and brush 2 is raised about the rearward universal joint 31 by operation of a lift chain 6 connected to the arm 10, viz: to a reinforcement plate 110 between the arm 10 and upright 11. Also connected to this plate 110 is a check chain 7 to limit outward swinging movement of the arm 10 about the universal joint 31.

As well as providing a better sweeping action by the brush 2, the mounting 1 is such that the various parts are readily accessible for servicing or replacement purposes.

Whereas the particular mounting 1 herein described and shown in the drawings provides a practical and robust arrangement, other suitable universal pivotal mounting of support for the rotary brush 2 from the arm 10 may be employed such as a universal joint carrying a support member for the brush from the forward end of the arm 10 and preferably centred on the axis of rotation of the brush.

I claim:

1. For a mobile sweeping machine for sweeping road, pavement and similar surfaces, a mounting for a rotary brush rotatable about a substantially vertical axis in position of use wherein the mounting comprises:

bracket structure mountable from an underpart of the machine;

a swing arm mounted at one end by universal joint connection to the bracket structure for angular movement in generally horizontal and vertical planes and whereby said swing arm is non-rotatable about its longitudinal axis;

a first support member positioned at the other end of the swing arm and pivotally carried thereby about a longitudinal axis closely parallel with the axis of the arm;

a second support member pivotally carried by the first support member about a transverse axis intersecting the longitudinal axis of pivotal movement of the first support member in order to provide universal pivotal mounting of the second support member from the arm;

a downwardly directed rotary brush carried by and below the second support member and rotatable about a substantially vertical axis whereby back and forth and sideways inclination of the axis of rotation of the brush is able to take place in a universal manner;

a motor carried by the second support member for directly driving the rotary brush;

spring means connected between the swing arm and the second support member for yieldably urging the latter to a position for rotation of the brush about a substantially vertical axis; and movement damping means connected between the swing arm and second support member for operation in conjunction with the spring means and for damping the universal pivotal movement which the second support member is otherwise able to freely follow in enabling the brush to closely follow varying surface formation in sweeping contact therewith in a self-accommodating manner.

2. A rotary brush mounting according to claim 1 wherein the substantially vertical axis of rotation of the brush intersects the intersection of the longitudinal and transverss axes of universal pivotal movement of the second support member.

3. A rotary brush mounting according to claim 1 wherein the first support member is forked to provide a pair of fork limbs which pivotally support between them the second support member for pivotal movement thereof about the transverse axis.

4. A rotary brush mounting according to claim 1 wherein the spring means and the damping means are connected between an upright member fixed on the swing arm and the second support member.

5. A rotary brush mounting according to claim 1 wherein the spring means is connected in an offset manner to the second support member in relation to the longitudinal and transverse axes of universal pivotal movement of the latter.

6. A rotary brush mounting according to claim 1 wherein the movement damping means is connected in an offset manner to the second support member in relation to the longitudinal and transverse axes of universal pivotal movement of the latter.

7. A rotary brush mounting according to claim 1 wherein further movement damping means is connected between the swing arm and bracket structure to damp angular movement of the swing arm.

8. A rotary brush mounting according to claim 7 wherein the further movement damping means is connected between the upright fixed on the swing arm and the bracket structure.

9. A rotary brush mounting according to claim 1 wherein stop means is provided acting between the swing arm and the first support member to limit pivotal movement of the latter about the longitudinal axis and hence sideways inclination of the axis of rotation of the brush.

10. A rotary brush mounting according to claim 1 wherein means is provided for limiting pivotal movement of the second support member about the transverse axis and hence back and forth inclination of the axis of rotation of the brush.

* * * * *